United States Patent [19]

Froehlich

[11] 4,108,800

[45] Aug. 22, 1978

[54] CLEANING COMPOSITION

[75] Inventor: Helmut H. Froehlich, Wilmington, Del.

[73] Assignee: Milliken Research Corporation, Spartanburg, S.C.

[21] Appl. No.: 755,751

[22] Filed: Dec. 30, 1976

Related U.S. Application Data

[63] Continuation of Ser. No. 562,245, Mar. 26, 1975, abandoned.

[51] Int. Cl.[2] ..... C11D 1/72

[52] U.S. Cl. ..... 252/541; 8/142; 252/8.9; 252/88; 252/89 DC; 252/364; 252/544; 252/DIG. 1

[58] Field of Search ..... 252/544, 541, 88, 364, 252/8.9, 89 DC, DIG. 1; 8/79, 142

[56] References Cited

U.S. PATENT DOCUMENTS

| | | | |
|---|---|---|---|
| 2,665,256 | 1/1954 | Barber | 252/544 |
| 3,630,919 | 12/1971 | Sheaffer et al. | 252/88 |
| 3,832,310 | 8/1974 | Grand | 252/544 X |
| 4,013,594 | 3/1977 | Froehlich et al. | 252/544 |

*Primary Examiner*—Thomas J. Herbert, Jr.
*Attorney, Agent, or Firm*—Robert S. Alexander; H. William Petry

[57] ABSTRACT

Polyethylene glycol added to semi-dry powdered cleaning compositions to prevent adhering of fine particles of the cleaning powder to the fibers being cleaned.

3 Claims, No Drawings

CLEANING COMPOSITION

This is a continuation of application Ser. No. 562,245, filed Mar. 26, 1975 now abandoned.

BACKGROUND OF THE INVENTION

Carpet cleaning compositions have recently been developed which are handled as dry powders. These comprise finely divided organic polymer particles, a cleaning fluid which can be an organic liquid or water or a combination of these, and surfactants, antistatic agents and other optional additives such as odorants. Such compositions function by dissolving the soil with the cleaning liquid, absorbing it into the polymer particles, and removing the particles and their absorbed soil by vacuum. Particularly satisfactory cleaning compositions of this type are described in detail in the copending, coassigned application of Froehlich and Lautenberger, U.S. Ser. No. 433,707, filed Jan. 16, 1974 now U.S. Pat. No. 4,013,594, and its German equivalent application P 2261587.8, published June 15, 1974, both hereby incorporated by reference.

While compositions of this kind have been shown to provide excellent carpet cleaning, especially small polymer particles can occasionally adhere to the textile fibers being cleaned after removal of the majority of the particles. This causes an objectionable discoloration, or "frosted" appearance, particularly noticeable on dark colored articles. Since cleaning procedures necessarily agitate the particles in contact with fibers and soil deposits, it is normally impossible to prevent formation of some of the especially small particles due to attrition of the particles grinding against one another. The ordinary methods for removing the soil and the particles, such as vacuum cleaning and brushing, are not capable of removing these very fine polymer residues.

SUMMARY OF THE INVENTION

The present invention provides an improved cleaning composition that prevents the adherence of finely divided polymer particles onto the fiber being cleaned, and facilitates their removal with the larger particles.

Specifically, there is provided, in a powdered cleaning composition comprising about from 30% to 90% particulate polymeric urea-formaldehyde and about from 10% to 70% fluid, the urea-formaldehyde polymer having a particle size of about from 10 to 105 microns and the fluid consisting essentially of up to 100% water containing sufficient surfactant to give a surface tension of less than 40 dynes per centimeter and up to 100% of an organic liquid selected from high boiling hydrocarbon solvents, tetrachloroethylene, methylchloroform, 1,1,2-trichloro-1,2,2-trifluoroethane, an aliphatic alcohol containing from 1 to 4 carbon atoms and mixtures of these, the improvement wherein the composition further comprises about from 0.25% to 5.0% of a polyethylene oxide having a molecular weight of at least about 20,000 and the organic liquid comprises up to about 40% of the fluid in the composition.

DETAILED DESCRIPTION OF THE INVENTION

The polyethylene oxides which can be used in the present invention include those having a molecular weight of at least about 20,000. The beneficial effects of the invention are markedly depreciated at lower molecular weights. Commercial products are available with molecular weights up to about 5,000,000 and all of these function to prevent the undesirable discoloration or "frosting" of carpets when cleaned. It has been found that higher molecular weight polyethylene oxides function more satisfactorily, the provide the benefits of the present invention at lower concentrations. Accordingly, it is preferred to use polyethylene oxides having a molecular weight of at least 100,000. These higher molecular weight materials can be effectively used at concentrations of 0.25 to 1.25% by weight of the cleaning composition. Little additional benefit is obtained by the inclusion of quantities of polyethylene oxide in excess of the ranges indicated. A number of different molecular weights are available commercially. Among these are a series of products named "Polyox" manufactured by Union Carbide Corporation.

In the preparation of the improved cleaning compositions, the polyethylene oxide can be dissolved in the water to be used in the cleaning composition. The surfactants, odorant, and organic solvent (if used) can then be mixed in and the fluid mixture blended with the dry polymeric particulates. Alternatively, at least some of the surfactant can be dissolved in the organic solvent and the polyethylene oxide suspended therein with efficient agitation. The bulk of the water used can then be added, the polyethylene oxide dissolving in the aqueous phase. A second solution containing a relatively small amount of water plus the remaining additives can then be added, and the combined fluid blended with the polymer particles.

Compositions without organic solvent can also be prepared by dry blending solid polyethylene oxide with the polymer particles, then blending with an aqueous solution of the other constituents.

In preparing the present cleaning compositions, the cleaning fluid can be water containing sufficient surfactant to lower the surface tension to below 40 dynes per centimeter or mixtures of water, surfactant and organic liquid. Up to about 40% of the fluid can be an organic liquid. It has been found that when organic liquids comprise more than about 40% of the cleaning fluid in the composition, it is difficult to formulate the cleaning composition since the polyethylene oxide is insoluble in most organic liquids.

The present cleaning compositions, having the required polyethylene oxide, result in the excellent soil removal that is characteristic of compositions of this type. However, in addition, the compositions of the present invention nearly completely eliminate the residual fine polymer particles that were frequently left after removal of the bulk of the cleaning compositions previously. Thus, the objectionable discoloration or "frosting" is eliminated while retaining the absorptive soil removal characteristics of these cleaning compositions. The mechanism by which the present invention operates is not fully understood.

In the following examples, which further illustrate this invention, parts and percentages are by weight unless otherwise specified.

EXAMPLE 1

A reaction vessel was charged successively with 333 parts of water, 68.8 parts of urea, 38.1 parts of formaldehyde (as 37% aqueous solution containing about 11% methanol as stabilizer) and 1.07 parts of a surfactant consisting essentially of the reaction product of 10 mols ethylene oxide with 1 mole oleyl alcohol. With the temperature at 23° C there was added 1 part of HCl as 37% hydrochloric acid. After agitating the mass for 2 hours, the solid product was isolated by filtration and washed with water until the wash water was free of acid. The solid was dried at 120°–125° C in a vacuum oven. The resulting urea-formaldehyde particles had a compact, cohesive configuration, exhibiting a bulk density of greater than 0.2 g/cc.

A cleaning composition was prepared by first dissolving 5 parts of polyethylene oxide having a molecular weight of about 100,000 in 182 parts of water. To this was then added 2 parts of disodium phosphate, 30 parts of a 50% aqueous solution of stearyltrimethylammonium chloride, 15 parts of octylphenoxypolyethoxy ethanol where 5 moles of ethylene oxide have been added to each mole of octyl phenol, 0.7 part of "Calcofluor" White RW, which is Colour Index Fluorescent Brightener 61, aminocoumarin and 0.1 part of lemon odorant. Then 129.7 parts of odorless hydrocarbon solvent was added and dispersed thoroughly and the fluid mixture was blended thoroughly with 635.8 parts of urea-formaldehyde polymer particles as prepared above which contained 85.8 parts of water. The polymer particles had a bulk density of 0.349 gram per cubic centimeter and a surface area of 29 square meters/gram as measured by nitrogen absorption. The particle size distribution was 49% between 100 mesh and 170 mesh, particle size 88 microns to 149 microns 49% between 170 mesh and 325 mesh, particle size 44 microns to 88 microns 2% through 325 mesh, particle size <44 microns.

The prepared composition was used to clean a soiled dark blue carpet. The carpet was first treated with 1.2 ounces per square yard of a prespray of the following composition.

80.00% $H_2O$ 13.48% methylchloroform 5.70% odorless hydrocarbon solvent 0.12% 50% aqueous solution of stearyltrimethylammonium chloride 0.06% octylphenoxypolyethoxyethanol (5 moles ethylene oxide per mole)

0.03% of $C_nF_{2n+1}CH_2CH_2O(CH_2CH_2O)_xH$ where $n$ is 6 to 14 and $x$ is about 11

0.014% of aminocoumarin, ("Calcofluor" White RW)

0.020% of lemon odorant 0.564% of 1,4-dioxane 0.006% of secondary butyl alcohol 0.006% of 1,2-butylene oxide The spray with its combination of solvents and surfactants helps to loosen soil, making it more susceptible to removal by the subsequent application of the powder cleaner.

The above described dry powder cleaning composition was applied evenly to the blue high-low loop nylon carpet at a rate of one pound of the cleaner to 50 square feet of carpet. The powder was thoroughly worked into the carpet with an 18-inch diameter roto-oscillator machine driving brushes which rotated at 40 revolutions per minute and oscillated at 3600 oscillations per minute. After about 1½ hours drying time, the cleaner particles were removed with an efficient vacuum cleaner. A tape, 2 inches in diameter, had been placed across a part of the carpet before the prespray application. Removal of the tape and examination of the carpet indicated practically no adhering deposit of light colored cleaner particles not removed by vacuuming. The treated and untreated portions of the carpet had the same lustrous blue shade.

A Control Experiment was conducted using the same procedure except that the polyethylene oxide was omitted from the cleaning composition. The part of the carpet that had been covered by the tape appeared dark blue and lustrous in comparison to the cleaned area. The cleaned portion was delustered and appeared relatively dull due to an irremovable coating of very small polymer cleaner particles.

EXAMPLE 2

The procedure of Example 1 was repeated, except that the carpet cleaning composition was applied at a rate of 1 lb to 20 sq ft of carpet. At this higher rate of application more frosting was seen than at lower rates without the inclusion of polyethylene oxide. Inclusion of the high molecular weight polyethylene oxide in the formulation, however, resulted in complete removal of polymer particles and restoration of the inherent luster of the carpets treated.

EXAMPLE 3

A cleaning composition was prepared by (1) dissolving 5 parts of polyethylene oxide having a molecular weight of 600,000 ("Polyox" WSR-205), 2.0 parts disodium phosphate and 30.0 parts of a 50% aqueous solution of stearyltrimethylammonium chloride in 182 parts of water at 60° C; (2) in another vessel adding 15 parts octylphenoxypolyethoxyethanol (5 moles ethylene oxide per mole), 0.7 part aminocoumarin ("Calcofluor" White RW) and 0.1 part lemon odorant to 129.7 parts of odorless hydrocarbon solvent. The two fluids prepared in (1) and (2) were mixed together in a high-shear mixer to form an emulsion which was blended with 635.8 parts of urea-formaldehyde polymer particles prepared in Example 1 containing 85.8 parts of water.

The prepared cleaner was tested in the same manner and at the same rate as in Example 1 on a blue, low-level, modacrylic fiber carpet. The cleaner of the present invention containing the 600,000 molecular weight polyethylene oxide left substantially no visible adherent residue, the treated carpet having the same bright appearance as the portion covered by the tape. When the same procedure was followed using a control cleaning composition without the polyethylene oxide, a dull unremovable deposit of fine polymer particles remained on the fibers, giving a delustered appearance in comparison to the untreated portion of the carpet.

EXAMPLE 4

The procedure of Example 3 was repeated, except that a polyethylene oxide of 4,000,000 molecular weight ("Polyox" WSR 301) was used instead of the 600,000 molecular weight product used in that example. On testing, the same results were obtained.

EXAMPLE 5

A cleaning composition was prepared containing no organic solvent. A first fluid (1) was prepared by dissolving 1 part of octylphenoxypolyethoxyethanol (5 moles ethylene oxide per mole) in 1100 parts of water at 60° C. and adding gradually 40 parts of polyethylene oxide of 900,000 molecular weight ("Polyox" WSR 1105) with rapid stirring to give a solution. A second fluid (2) was prepared by mixing 65 parts of water, 8 parts of disodium phosphate, 160 parts of a 50% aqueous solution of stearyltrimethylammonium chloride, 79 parts of octylphoxypolyethoxyethanol (5 moles ethylene oxide per mole), 2.8 parts of aminocoumarin ("Calcofluor" White RW), and 0.4 part of lemon odorant. The second fluid was added to and mixed with the first, then 1347 parts of the combined fluid was blended with 2353 parts of urea-formaldehyde particles. These particles had a bulk density of 0.333 grams per cubic centimeter and the following particle size distribution.

61% between 100 mesh and 170 mesh
36% between 170 mesh and 325 mesh
3% through 325 mesh The prepared cleaner, when tested as in Example 1, left almost no objectionable adhering deposit.

I claim:

1. In a powdered cleaning composition comprising about from 30% to 90% particulate polymeric urea-formaldehyde and about from 10% to 70% fluid, the urea-formaldehyde polymer having a particle size of about from 10 to about 105 microns and the fluid consisting essentially of up to 100% water containing sufficient surfactant to give a surface tension of less than 40 dynes per centimeter and up to 100% of an organic liquid selected from high boiling hydrocarbon solvents, tetrachloroethylene, methylchloroform, 1,1,2-trichloro-1,2,2-trifluoroethane, an aliphatic alcohol containing from 1 to 4 carbon atoms and mixtures of these, the improvement wherein the composition further comprises about from 0.25% to 5.0%, by weight of the cleaning composition, of a polyethylene oxide having a molecular weight of at least about 20,000 and the organic liquid comprises up to about 40% of the fluid in the composition.

2. A cleaning composition of claim 1 wherein the polyethylene oxide has a molecular weight of at least about 100,000.

3. A cleaning composition of claim 2 wherein the polyethylene oxide comprises about from 0.25% to 1.25% by weight of the cleaning composition.

* * * * *